US006566026B2

(12) United States Patent
Watanabe et al.

(10) Patent No.: US 6,566,026 B2
(45) Date of Patent: May 20, 2003

(54) TONER FOR DEVELOPING ELECTROSTATIC LATENT IMAGE, TONER CONTAINER CONTAINING THE TONER, AND IMAGE FORMING METHOD AND APPARATUS USING THE TONER

(75) Inventors: Yohichiroh Watanabe, Fuji (JP); Masanori Suzuki, Shizuoka-ken (JP); Masahide Yamashita, Numazu (JP); Keiko Shiraishi, Susono (JP); Kazuhito Watanabe, Numazu (JP); Kohki Katoh, Shizuoka-ken (JP); Toyoshi Sawada, Odawara (JP); Takuya Saito, Numazu (JP)

(73) Assignee: Ricoh Company,. Ltd., Tokyo (JP)

( * ) Notice: Subject to any disclaimer, the term of this patent is extended or adjusted under 35 U.S.C. 154(b) by 0 days.

(21) Appl. No.: 09/891,652

(22) Filed: Jun. 26, 2001

(65) Prior Publication Data

US 2002/0037467 A1 Mar. 28, 2002

(30) Foreign Application Priority Data

Jun. 26, 2000 (JP) ..... 2000-191130
Jun. 25, 2001 (JP) ..... 2001-191080

(51) Int. Cl.[7] ..... G03G 9/08
(52) U.S. Cl. ..... 430/110.1; 430/108.8
(58) Field of Search ..... 430/110.1, 108.8

(56) References Cited

U.S. PATENT DOCUMENTS

| | | | | |
|---|---|---|---|---|
| 4,908,290 | A | 3/1990 | Watanabe et al. | 430/106.6 |
| 4,956,258 | A | 9/1990 | Watanabe et al. | 430/109 |
| 5,168,028 | A | 12/1992 | Nanya et al. | 430/110 |
| 5,288,577 | A | 2/1994 | Yamaguchi et al. | 430/106.6 |
| 5,368,972 | A | 11/1994 | Yamashita et al. | 430/137 |
| 5,380,616 | A | 1/1995 | Aoki et al. | 430/110 |
| 5,429,901 | A | 7/1995 | Muto et al. | 430/110 |
| 5,773,185 | A | 6/1998 | Yachi et al. | 430/137 |
| 5,840,456 | A | 11/1998 | Tomita et al. | 430/106 |
| 5,882,832 | A | 3/1999 | Tosaka et al. | 430/106 |
| 6,004,715 | A | 12/1999 | Suzuki et al. | 430/111 |
| 6,010,814 | A | 1/2000 | Kotsugai et al. | 430/110 |
| 6,074,794 | A | 6/2000 | Fushimi et al. | 430/109 |
| 6,074,795 | A | 6/2000 | Watanabe et al. | 430/109 |
| 6,103,441 | A | 8/2000 | Tomita et al. | 430/110 |
| 6,168,894 | B1 | 1/2001 | Aoki et al. | |
| 6,177,223 | B1 * | 1/2001 | Hashimoto et al. | 430/108.8 |
| 6,180,298 | B1 | 1/2001 | Kuroda et al. | 430/45 |
| 6,183,926 | B1 | 2/2001 | Kuroda et al. | 430/106.6 |

FOREIGN PATENT DOCUMENTS

| | | |
|---|---|---|
| JP | 05061242 | 3/1993 |
| JP | 08220808 | 8/1996 |
| JP | 09106105 | 4/1997 |
| JP | 09304964 | 11/1997 |
| JP | 10293425 | 11/1998 |

OTHER PUBLICATIONS

U.S. patent application Ser. No. 08/037,723, filed Mar. 26, 1993.
U.S. patent application Ser. No. 09/579,138, filed May 30, 2000.
U.S. patent application Ser. No. 09/493,186, filed Jan. 28, 2000.
Patent Abstracts of Japan, vol. 1997, No. 09, Sep. 30, 1997, abstracts of JP 09 138525, May 27, 1997.

* cited by examiner

*Primary Examiner*—Mark A. Chapman
(74) *Attorney, Agent, or Firm*—Cooper & Dunham LLP

(57) ABSTRACT

A toner including mother toner particles including at least two resins A and B and a wax each of which is incompatible with the others; and an external additive including at least one of a particulate inorganic material and a particulate resin, wherein the resins and wax form a sea-island structure in which the resin B is present like islands in a sea of the resin A and the wax is substantially included in the resin B while dispersed therein, and wherein the resin A does not include a component insoluble in tetrahydrofuran and has a weight average molecular weight of from 10,000 to 90,000.

26 Claims, 3 Drawing Sheets

TONER FOR DEVELOPING ELECTROSTATIC LATENT IMAGE, TONER CONTAINER CONTAINING THE TONER, AND IMAGE FORMING METHOD AND APPARATUS USING THE TONER

BACKGROUND OF THE INVENTION

1. Field of the Invention

The present invention relates to a toner for developing an electrostatic latent image prepared by an image forming method such as electrophotography, electrostatic recording and electrostatic printing. In addition, the present invention relates to a toner container, and to an image forming method and apparatus using the toner.

2. Discussion of the Related Art

A typical image forming method using electrophotography is as follows:

(1) forming an electrostatic latent image on an image bearing member such as photoreceptors;
(2) developing the latent image with charge toner particles to form a toner image on the image bearing member;
(3) transferring the toner image on a receiving material such as paper; and
(4) fixing the toner image on the receiving material, resulting in output of a recorded image.

Recently, demands for color copiers and color printers are increasing more and more.

In color image forming methods using electrophotography, the processes mentioned above are typically repeated plural times using three primary color toners (i.e., a yellow toner, a magenta toner and a cyan toner) and a black toner to form a full color image in which the color toner images are overlaid.

In order to form a full color image having good color reproducibility and sharpness, the surface of a fixed color toner image should be smoothed to some extent to reduce light scattering. For such a reason, the color images produced by conventional full color copiers typically have a medium to high gloss of from 10 to 50%.

In general, as the fixing method for fixing a dry toner image on a receiving material, contact fixing methods in which a toner image is pressed by a heated roller or belt having a smooth surface have been typically used. These methods have an advantage such that the methods have high heat efficiency so that high speed fixing can be performed. In addition, the methods also have an advantage such that the resultant color toner image has a high gloss and a high transparency. However, the methods have a drawback such that an image offset problem tends to occur in which a part of a toner image adheres to the surface of a fixing roller and the part of the image is re-transferred onto other part of the receiving material and/or another receiving material having an image.

In attempting to solve this offset problem, a fixing roller whose surface is coated with a silicone rubber or a fluorine-containing resin and to which a releasing oil such as silicone oils is applied have been typically used for image forming apparatus. This method is effective to avoid the offset problem, but has drawbacks in that an oil applicator must be provided in the image forming apparatus, and thereby the image forming apparatus become large in size and have manufacturing high costs.

Therefore, in monochrome image forming apparatus a method a toner including a binder resin having a controlled molecular weight distribution and having high melt viscoelasticity has been used so as not to cause internal fracture when melted is typically used. In addition, a release agent such as waxes is typically included in the toner in order not to use an oil applicator or in order to use an oil applicator which applies a small amount of an oil to a fixing roller (hereinafter referred to as a small-amount-oil applicator).

However, as mentioned above, color images should be smoothed so as to have good color reproducibility, and therefore color toners have to have a relatively low melt viscoelasticity. Accordingly, color toners tend to cause the offset problem more frequently than monochrome toners having a relatively low gloss compared to color toners. Therefore, it is hard not to use an oil applicator or to use a small-amount-oil applicator. In addition, when a release agent is included in a toner, the following problems tend to occur:

(1) transferability of the toner to receiving materials deteriorates because the adhesion of the toner increases, resulting in increase of cohesive force of the toner or deterioration of fluidity of the toner; and
(2) the carrier which is mixed with the toner to charge the toner is contaminated with the release agent, resulting in deterioration of the charging ability of the carrier, and thereby the life of the developer shortens.

Conventionally, low molecular weight polyester resins and epoxy resins have been typically used as a binder resin for color toners because images having a high gloss can be easily produced. However, since these resins have a hydrophilic group such as a hydroxyl group, the resins have a drawback in that the charge quantity of the resultant toner largely changes as the humidity changes. In addition, currently the particle diameter of toner particles becomes smaller and smaller to produce high quality images. When a low molecular weight polyester resin or an epoxy resin is used as a toner constituent, it is relatively hard to pulverize the kneaded toner constituents compared to monochrome toners typically including a styrene type resin (i.e., such resins have poor pulverizability). Therefore such toners including a polyester resin or an epoxy resin have low productivity.

In view of such situations, Japanese Laid-Open Patent Publication No. (hereinafter JOP) 8-220808 discloses a toner including a linear polyester resin having a softening point of from 90 to 120° C. and carnauba wax. JOP 9-106105 discloses a toner including a resin and a wax, wherein they are compatible with each other and have different softening points. JOP 9-304964 discloses a toner including a polyester resin and a wax, wherein the melt viscosities of the resin and wax are specified. JOP 10-293425 discloses a toner including a polyester resin having a softening point of from 90 to 120° C., rice wax, carnauba wax and a silicone oil. JOP 5-61242 discloses a polymerized toner including a wax therein.

However, there is no toner having all the following advantages:

(1) capable of producing images having a proper gloss and good color reproducibility;
(2) not causing the offset problem even when an oil applicator is not used or a small-amount-oil applicator is used;
(3) having good transferability and durability;
(4) having good charge stability even when humidity changes; and
(5) having good pulverizability.

Because of these reasons, a need exists for a color toner having a combination of such advantages mentioned above.

SUMMARY OF THE INVENTION

Accordingly, an object of the present invention is to provide a color toner which has good transferability, durability, charge stability and pulverizability and which can produce a toner image having a proper gloss and good color reproducibility without causing the offset problem even when an oil applicator is not used or a small-amount-oil applicator is used.

Another object of the present invention is to provide an image forming method and apparatus in which a toner image having a proper gloss and good color reproducibility can be produced without causing the offset problem even when an oil applicator is not used for the fixing device or a small-amount-oil applicator is used.

To achieve such objects, the present invention contemplates the provision of a toner including mother toner particles including at least two resins A and B and a wax and an external additive including at least one of a particulate inorganic material and a particulate resin, wherein the resins A and B and the wax form a phase separation structure (i.e., a sea-island structure) in which the resin B is present like islands in a sea of the resin A and the wax is substantially present in the resin B while dispersed therein, and wherein the resin A does not include a component insoluble in tetrahydrofuran and has a weight average molecular weight of from 10,000 to 90,000 when measured by a gel permeation chromatography (GPC) method.

It is preferable that the resins A and B and the wax have different solubility parameters, SPa, SPb and SPw, respectively, wherein SPa is greater than SPb and SPb is greater than SPw.

In addition, it is preferable that SPa is greater than SPb by 0.6 or more.

Further, it is preferable that the content of the resin A in the toner is greater than that of the resin B, and the content of the resin B is greater than that of the wax. The contents of the resin A, resin B and wax are preferably from 55 to 96%, from 2 to 44% and from 2 to 15% by weight, respectively, based on total of the resins A and B and the wax.

It is preferable that the resin B can be pulverized more easily than the resin A and the wax (i.e., the resin B has better pulverizability than the resin A and the wax.

The wax dispersed in the resin B preferably has a maximum particle diameter (i.e., the diameter in the major axis direction) not less than 0.5 $\mu$m and not greater than one third of the maximum particle diameter of the toner.

The resin A preferably includes a polyester resin or a polyol resin.

The resin A preferably includes at least two resins having different weight average molecular weights determined by a GPC method. In addition, the difference between the solubility parameters of the two resins is preferably from 0.4 to 0.6.

It is preferable that the resin B includes no THF-insoluble component, and the weight average molecular weight thereof is preferably from 10,000 to 60,000.

The resin B is preferably a material in which a vinyl resin is grafted on a wax component, which serves as a wax-dispersion-accelerating agent.

It is preferable that the glass transition temperature of the resin A is lower than that of the resin B.

The wax preferably has a melting point of from 70 to 125° C., and a penetration not greater than 5. The wax is preferably one selected from the group consisting of carnauba wax, modified carnauba waxes and synthesized ester waxes.

The toner preferably includes at least a particulate inorganic material or a particulate resin as an internal additive.

In addition, it is preferable that the external additive includes a hydrophobized silica and a hydrophobized titanium oxide, wherein the hydrophobized titanium oxide is present in the toner in a greater amount than the hydrophobized silica. The hydrophobized silica preferably includes at least two hydrophobized silicas, one of which has an average primary particle diameter of from 0.01 to 0.03 $\mu$m and the other of which has a specific surface area of from 20 to 50 $m^2/g$.

The toner of the present invention preferably has an external additive including a hydrophobized silica, a hydrophobized titanium oxide, and a particulate resin having an average particle diameter not greater than one eighth of the average particle diameter of the mother toner particles.

In another aspect of the present invention, an image forming method including the steps of passing a receiving material having a toner image thereon through a nip between a heated fixing means and a pressing means such that the toner image contacts the heated fixing means to fix the toner image, wherein the toner is the toner of the present invention mentioned above. Preferably the heated fixing means is a heated fixing roller or belt, and the pressing means is a pressure roller and the heated fixing means has a heat-resistant elastic layer on the surface thereof, and is caved in at the nip.

In yet another aspect of the present invention, a toner container is provided which has an opening and contains the toner of the present invention therein.

In a further aspect of the present invention, an image forming apparatus including an image bearing member configured to bear an electrostatic latent image, a toner container containing a toner, an image developer configured to develop the latent image with the toner to form a toner image on the image bearing member, an image transfer device configured to transfer the image on a receiving material, and a fixer configured to fix the toner image on the receiving material, wherein the toner is the toner of the present invention. Preferably the fixer includes a combination of a fixing belt, a heat roller and a pressure roller or a combination of a fixing roller and a pressure roller. The heated fixing roller and belt preferably have a heat resistant elastic layer and are caved in at the nip between the fixing belt (or the fixing roller) and the pressure roller.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Figure 1:
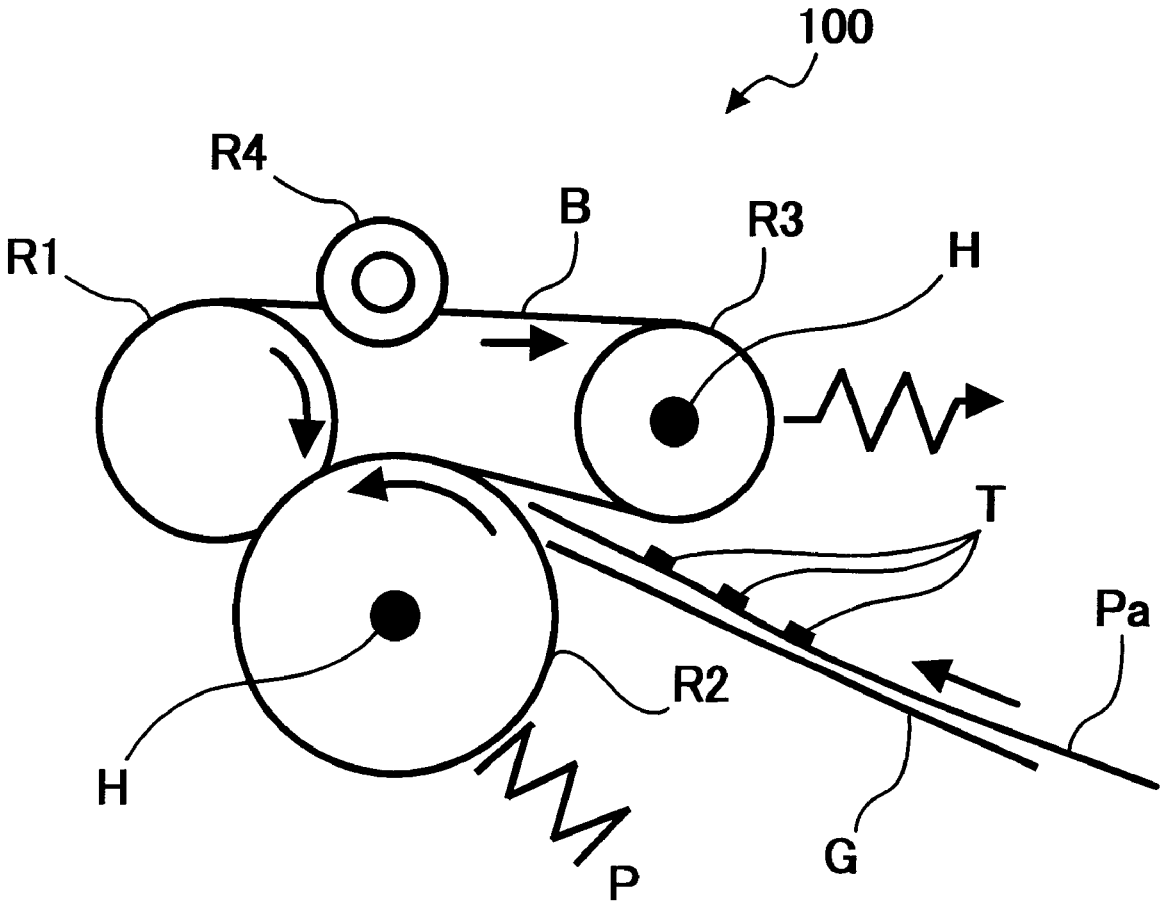
FIG. 1 is a schematic view illustrating the sectional view of a fixer using a fixing belt for use in the image forming apparatus of the present invention.

The toner of the present invention includes at least two resins, resins A and B, and a wax, wherein each of the resins A and B and the wax is incompatible with the others and have a sea-island structure in which the resin B is present as islands in a sea of the resin A and the wax is substantially included in the resin B while dispersed therein. The term "incompatible" means that each of the resins A and B and wax does not substantially mix with the others. In order to securely form this sea-island structure, the following relationship is preferably satisfied:

$$SPa>SPb>SPw$$

wherein SPa, SPb and SPw represent solubility parameters of the resin A, resin B and wax, respectively.

In addition, SPa is preferably greater than SPb by 0.6 or more. Further, it is preferable that the contents of the resin A, resin B and wax are preferably from 55 to 96% by weight, from 2 to 44% by weight and from 2 to 15% by weight, respectively, based on the total weight of the resin A, resin B and wax.

Conventionally, a composition including a resin and a wax and having a sea-island structure in which the wax is present as islands in a sea of the resin has been used for toners. When such a composition is kneaded and then pulverized to prepare a mother toner, a stress is concentrated in the interfaces between the resin and the wax in the pulverization process. Therefore, the mixture tends to be pulverized at the interfaces, and thereby the wax tends to be present on the surface of the resultant mother toner particles, resulting in deterioration of the transferability and durability of the resultant toner.

In contrast, in the toner of the present invention the resin B including the wax therein is present as islands in a sea of the resin A, and therefore the stress is also concentrated in the interfaces between the resin A and the resin B in a pulverization process. Therefore, the possibility that the wax is present (i.e., exposed) on the surface of the toner particles decreases, and thereby a toner having good transferability and durability can be prepared. In addition, since the wax is present in a surface portion of the toner particles, the resultant toner has good offset resistance. In addition, the area of the interfaces in which the pulverization stress is concentrated increases. Namely, the interfaces include the interfaces between the islands (i.e., the resin B) and the sea (i.e., the resin A) and the interfaces between the resin B and the wax. Therefore, the pulverizability of the mother toner block (i.e., a kneaded mixture including the resins A and B and the wax) is improved, and thereby a toner having a relatively small particle diameter can be efficiently prepared.

In addition, since the resin B has better pulverizability than the resin A, the pulverization efficiency can be improved and the possibility that the wax is present in a surface portion of the toner particles can also be increased, resulting in prevention of the offset problem. In addition, it is preferable that the resin B is pulverized more easily than the wax included in the resin B to prevent the wax from causing internal fracture (i.e., being separated into two or more pieces) in the pulverization process, and thereby the possibility that the wax is present (i.e., exposed) on the surface of the toner particles decreases, resulting in improvement of the transferability and durability of the resultant toner.

In view of the color reproducibility, color toner images preferably have a gloss not less than 10%. In order to produce such glossy images, it is preferable that the resin A does not have a component insoluble in tetrahydrofuran (hereinafter referred to as a THF-insoluble component) and has a weight average molecular weight not greater than 90,000, and preferably not greater than 50,000. In addition, it is preferable that the resin B does not include a THF-insoluble component and has a weight average molecular weight not greater than 60,000. When both the resin A and resin B have a weight average molecular weight not greater than 10,000, a toner having good offset resistance cannot be provided.

Suitable resins for use as the binder resins (i.e., the resins A and B) in the toner of the present invention include known resins. Specific examples of such resins include polymers and copolymers of monomers such as styrene, parachlorostyrene, vinyl toluene, vinyl chloride, vinyl acetate, vinyl propionate, methyl (meth)acrylate, ethyl (meth)acrylate, propyl (meth)acrylate, n-butyl (meth) acryalte, isobutyl (meth)acrylate, dodecyl (meth)acrylate, 2-ethylhexyl (meth)acrylate, lauryl (meth)acrylate, 2-hydroxyethyl (meth)acrylate, hydroxypropyl (meth) acrylate, 2-chloroethyl (meth)acrylate, (meth)acrylonitrile, (meth)acrylyamide, (meth)acrylic acid, vinyl methyl ether, vinyl ethyl ether, vinyl isobutyl ether, vinyl methyl ketone, N-vinyl pyrrolidone, N-vinylpyridine, and butadiene. In addition, these resins can be used in combination. Further, polyester resins, polyol resins, polyurethane resins, polyamide resins, epoxy resins, rosin, modified rosins, terpene resins, phenolic resins, hydrogenated petroleum resins can also be used alone or in combination.

Among these resins, polyester resins and polyol resins are preferable for the resin A. Among the polyol resins, polyether polyol resins having an epoxy skeleton are preferably used. Suitable polyether polyol resins having an epoxy skeleton include polyol resins prepared by reacting the following components:

(1) an epoxy resin;
(2) an adduct of a dihydric phenol with an alkylene oxide, or its glycidyl ether compound; and
(3) a compound having an active hydrogen which can react with an epoxy group.

As for the resin B, styrene resins, in particular, styrene-(meth)acrylic acid alkyl ester copolymer can be preferably used because of having good charge stability even when the humidity changes, and good pulverizability.

It is preferable to use as the resin B a resin material in which a vinyl resin is grafted on a wax because the wax can be finely dispersed in the resin B and thereby the quantity of the wax present (i.e., exposed) on the surface of the toner decreases, resulting in improvement of the transferability and durability of the resultant toner.

Since the content of the resin B on the surface of the toner tends to become greater than the content thereof in the toner, it is preferable that the resin B has a higher glass transition temperature than the resin A because the resultant toner hardly contaminates a frictional charge imparting material such as carriers, resulting in improvement of durability, and the resultant toner has good resistance to blocking even when used at a relatively high temperature condition. At this point, the glass transition temperature is defined as the shoulder value in a calorimetric curve obtained by differential scanning calorimeter (DSC).

In the present invention, the resin A preferably has a greater solubility parameter (hereinafter sometimes referred to SP) as than the resin B. In addition, the resin B preferably has a greater solubility parameter than the wax included in the resin B. Further, the difference between the solubility parameter of the resin A and the solubility parameter of the resin B is preferably not less than 0.6.

When two or more resins are used, for example, for the resin A, the average solubility parameter of the resin A, which can be determined by averaging the solubility parameters of the resins A1 and A2 while weighting the solubility parameters based on the contents thereof, is preferably greater than that of the resin B.

In the present application, the solubility parameter (δ) is defined by the following Hildebrand-Scatchard equation:

$$\delta=(\Delta Ev/V)^{1/2}$$

wherein ΔEv represents an evaporation energy; and V represents a molar volume, namely, ΔEv/V represents a cohesive energy density.

The solubility parameter can be determined by various methods. In the present invention, the solubility parameter of the resins A and B are determined by the following equation using the Fedor method in which the solubility parameter of a resin is calculated based on its monomer composition:

$$\delta=(\Sigma\Delta ei/\Sigma\Delta vi)^{1/2}$$

wherein Δei represents an evaporation energy of an atom or an atomic group; and Δvi represents the molar volume of the atom or the atomic group.

In the present invention, the resin B has better pulverizability than the resin A, and the wax included in the resin B. The pulverizability of materials 1 and 2 can be compared as follows:

Each of the materials 1 and 2 is pulverized by an air pulverizer under the same conditions. Then the average particle diameters of the pulverized materials 1 and 2 are measured. If the particle diameter of the material 1 is smaller than that of the material 2, it can be said that the material 1 has better pulverizability than the material 2.

In the present invention, the resin A does not include a THF-insoluble component. In the present application, the percentage of THF insoluble components in a resin is determined as follows:

(1) a resin sample of about 1.0 gram is precisely weighed;
(2) the resin is mixed with 50 grams of tetrahydrofuran (THF) and is allowed to settle at 20° C. for 24 hours;
(3) the mixture is filtered using a filter paper 5C specified in JIS (Japanese Industrial Standards) P3801 whose weight is preliminarily measured;
(4) the filter paper is dried to remove THF therefrom;
(5) the filter paper is weighed to determine whether there is a residue in the filter paper.

The percentage of THF-insoluble components in the resin included in a toner is determined as follows:

(1) a toner sample of about 1.0 gram is precisely weighed;
(2) the toner is mixed with 50 grams of THF and is allowed to settle at 20° C. for 24 hours;
(3) the mixture is filtered using a filter paper 5C specified in JIS (Japanese Industrial Standards) P3801 whose weight is preliminarily measured;
(4) the filter paper is dried to remove THF therefrom; and
(5) the filter paper is weighed to determine the weight of the THF insoluble materials.

At this point, the weight of the THF-insoluble solids included in the toner, such as colorants and charge controlling agents, should be subtracted from the weight of the THF insoluble materials to determine the THF insoluble components in the resin in the toner.

In the present invention, the passage "resin A does not include a THF-insoluble component" means that the percentage determined above is 0, and the error due to the measurements is about ±0.5%. The passage "resin B does not include a component insoluble in tetrahydrofuran" has the same meaning.

In the present invention, the weight average molecular weight is measured by a gel permeation chromatography (GPC) method, which is as follows:

(1) a column is heated in a heat chamber of 40° C. such that the temperature of the column becomes 40° C.; and
(2) 50 to 200 μl of a resin solution of THF having a resin content of from 0.05 to 0.6% by weight is injected to the column while a solvent, THF, is flown at a flow rate of 1 ml/min through the column, to measure the weight average molecular weight.

When the molecular weight of a sample is determined, a working curve showing the relationship between molecular weights and counts detected by the GPC is preliminarily prepared using several standard polystyrenes having a mono molecular weight. The weight average molecular weight can be determined using this working curve.

As for such standard polystyrenes, it is preferable to use at least ten polystyrenes, for example, having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$. Such standard polystyrenes can be commercially available, for example, from Pressure Chemical Co., or Toso Co., Ltd.

As for the detector for the GPC, a RI (refractive index) detector is preferably used.

As the wax for use in the toner of the present invention, which serves as a release agent, any know waxes can be used. Specific examples of such waxes include low molecular weight polyolefins such as polyethylene and polypropylene; synthetic waxes such as Fisher-Tropsch waxes; natural waxes such as bees wax, carnauba wax, candelilla wax, rice wax and montan wax; petroleum waxes such as paraffin waxes and microcrystalline waxes; higher fatty acids such as stearic acid, palmitic acid and myristic acid, and their metal salts; higher fatty acid amides, synthesized ester waxes, etc. These waxes can be used alone or in combination.

Among these waxes, carnauba wax, modified carnauba waxes, and synthesized ester waxes are preferable because these waxes can be dispersed in a polyester resin or a polyol resin such that the dispersed wax has a suitable particle diameter, and thereby a toner having good transferability, durability and offset resistance can be easily prepared.

The wax for use in the toner of the present invention preferably has a melting point of from 70 to 125° C. When the melting point of the wax is not lower than 70° C., the resultant toner has good transferability and durability. When the melting point is not higher than 125° C., the resultant toner quickly melts when the toner is heated to be fixed, resulting in exertion of good release effect, and thereby the offset problem can be avoided.

The content of such a release agent (i.e., wax) in the toner is preferably from 2 to 15% by weight to impart good offset resistance, transferability and durability to the resultant toner.

It is preferable that the wax is incompatible with the resin B in the toner. In view of the transferability and durability, the maximum particle diameter (i.e., the major axis particle diameter) of the wax dispersed in the resin B is not greater than one half, and preferably one third, of the maximum particle diameter of the toner. When the maximum diameter of the wax is not greater than 0.5 μm, the wax tends not to bleed and thereby the resultant toner has poor offset resistance.

The maximum particle diameter of a wax in a toner can be determined as follows:

(1) a toner is added in a solvent which dissolves the resin in the toner but does not dissolve the wax in the toner to dissolve the resin; and (2) the wax in the liquid is observed with a microscope of 1000 power magnification to determine the maximum particle diameter of the wax.

The maximum particle diameter of the toner can be determined as the average particle diameter of the largest particle diameter range, in which the maximum particle diameter is included, in the particle diameter distribution graph of the toner prepared using a Coulter counter.

The solubility parameter of a wax is determined based on the solubility of the wax in various solvents whose solubility parameters are known.

Suitable colorants for use in the toner of the present invention include known dye and pigments which have been used for color toners.

Specific examples of the yellow colorants include cadmium yellow, Mineral Fast Yellow, Nickel Titan Yellow, naples yellow, Naphthol Yellow S, Hansa Yellow G, Hansa Yellow 10G, Benzidine Yellow GR, Quinoline Yellow Lake, Permanent Yellow NCG, Tartrazine Yellow Lake, etc.

Specific examples of the orange colorants include Molybdenum Orange, Permanent Orange GTR, Pyrazolone Orange, Vulcan Orange, Indanthrene Brilliant Orange RK, Benzidine Orange G, Indanthrene Brilliant Orange GK, etc.

Specific examples of the red colorants include red iron oxide, cadmium red, Permanent Red 4R, Rithol Red, Pyrazolone Red, Watchung Red calcium salts, Lake Red D, Brilliant Carmine 6B, Eosine Lake, Rhodamine Lake B, alizarine lake, Brilliant Carmine 3B, etc.

Specific examples of the violet colorants include cobalt blue, Alkali Blue, Victoria Blue Lake, Phthalocyanine Blue, metal-free Phthalocyanine Blue, partially chlorinated Phthalocyanine Blue, Fast Sky Blue, Indanthrene Blue BC, etc.

Specific examples of the green colorants include chrome green, chromium oxide, Pigment Green B, Malachite Green Lake, etc.

Specific examples of the black colorants include carbon black, oil furnace black, channel black, lamp black, acetylene black, azine dyes such as Aniline Black, metal salts of azo dyes, metal oxides, complex metal oxides, etc.

These dyes and pigments can be used alone or in combination.

The toner of the present invention may include a charge controlling agent, if desired. Specific examples of the charge controlling agent include Nigrosine; azine dyes including an alkyl group having 2 to 16 carbon atoms (disclosed in Japanese Patent Publication (hereinafter referred to as JPP) No. 42-1627); basic dyes (e.g., C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42045), and C.I. Basic Green 4 (C.I. 42000)), and lakes of these basic dyes; C.I. Solvent Black 8 (C.I. 26150); quaternary ammonium chlorides such as benzoylmethylhexadecylammonium chloride and decyltrimethylammonium chloride; dialkyl tin compounds such as dibutyl tin and dioctyl tin; dialkyl tin borate compounds; guanidine derivatives; vinyl polymers having an amino group; polyamine resins such as condensation polymers having an amino group; metal complexes of monoazo dyes (disclosed in JPP Nos. 41-20153, 43-27596, 44-6397 and 45-26478); metal (e.g., Zn, Al, Co, Cr, and Fe) complexes of salicylic acid, dialkyl salicylate, naphthoic acid and dicarboxylic acids; sulfonated copper phthalocyanine; organic boron salts; fluorine-containing quaternary ammonium salts; calixarene compounds, etc. Charge controlling agents having white color, such as metal salts of salicylic acid derivatives, are preferably used for color toners other than black toners.

The toner of the present invention preferably includes an external additive such as inorganic particulate materials (e.g., silica, titanium oxide, alumina, silicon carbide, silicon nitride, boron nitride, etc.) and particulate resins. The external additive is added to mother toner particles to improve the transferability and durability of the resultant toner. The external additive covers the wax on the surface of the mother toner particles, which wax deteriorates transferability and durability. In addition, the external additive covers the surface of the mother toner particles, and thereby the area of the surface of the toner contacting other materials such as carriers and image bearing members can be decreased, resulting in improvement of the transferability and durability of the resultant toner. The inorganic particulate materials used as an external additive are preferably hydrophobized. In particular, hydrophobized metal oxides such as silica and titanium oxide are preferably used. Suitable particulate resins for use as the external additive include polymethyl methacrylate and polystyrene which are prepared by a soap-free emulsion polymerization method and which have an average particle diameter of from about 0.05 $\mu$m to about 1 $\mu$m.

A combination of a hydrophobized silica and a hydrophobized titanium oxide is preferably used as the external additive. In this case, it is preferable that the content of the hydrophobized titanium oxide is greater than that of the hydrophobized silica in the toner because the resultant toner can maintain good charge stability even when the humidity changes.

In addition, it is preferable to use a relatively large silica having a specific surface area of from 20 to 50 $m^2/g$ or a relatively large particulate resin having an average particle diameter of from one hundredth to one eighth of the average particle diameter of the toner in combination with the particulate inorganic material mentioned above, to improve the durability of the resultant toner. The reason is as follows:

When a relatively small metal oxide is used as an external additive for a toner, the metal oxide tends to be embedded in the mother toner particles when the toner is mixed with a carrier and agitated to be used for development. When such a relatively large external additive is used in combination with such a relatively small metal oxide, the metal oxide is prevented from being embedded in the mother toner particles.

The above-mentioned inorganic particulate materials and organic particulate materials can also be included in the toner as an internal additive. In this case, although the degree of the improvement of the transferability and durability is smaller than in the case in which the material is used as an external additive, the pulverizability of the mixture of toner constituents can be improved.

The toner in which one or more of the inorganic particulate materials and organic particulate resins are included as an internal additive can also include one or more of the inorganic particulate materials and particulate resins an external additive. In this case, the external additive is prevented from being embedded into the toner particles, and thereby the resultant toner has a combination of good transferability and good durability.

Specific examples of the hydrophobizing agents useful for hydrophobizing inorganic particulate materials include dimethyldichlorosilane, trimethylchlorosilane, methyltrichlorosilane, allyldimethyldichlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxysilane, vinyltriethoxysilane, vinylmethoxysilane, vinyl-tris(β-methoxyethoxy)silane, γ-methacryloxypropyltrimethoxysilane, vinyltriacetoxysilane, divinyldichlorosilane, dimethylvinylchlorosilane, octyl-trichlorosilane, decyl-trichlorosilane, nonyl-trichlorosilane, (4-t-propylphenyl)-trichlorosilane, (4-t-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyltrimethoxysilane, hexamethyldisilazane, hexaethyldisilazane, diethyltetramethyldisilazane, hexaphenyldisilazane, hexatolyldisilazane, etc.

In addition, titanate coupling agents and aluminum coupling agents can also be used as a hydrophobizing agent.

As an external additive, lubricants such as fatty acid metal salts, polyvinylidenefluoride powders, etc. can be used in combination with the inorganic particulate materials and particulate resins to improve the cleaning property of the resultant toner.

The toner of the present invention can be used as a one component developer and for two component developers.

When the toner is used for two component developers, the toner is mixed with a carrier. Suitable materials for use as the carrier include known carrier materials. Specific examples of such carrier materials include iron powders, ferrite powders, magnetite powders, nickel powders, glass beads, etc. These carrier materials may be coated with a resin, etc. The volume average particle diameter thereof is preferably from 25 to 200 μm.

The toner of the present invention can be manufactured by any one of known manufacturing methods.

At first toner constituents are kneaded upon application of heat thereto.

Suitable kneading machines useful for kneading toner constituents include batch-processing keaders such as two-roll kneaders and Banburry's mixers; continuous two-axis kneaders such as KTK type two-axis extruders (manufactured by Kobe Steel, Ltd.), TEM type two-axis extruders and KCK type two-axis extruders (manufactured by Toshiba Machine Co., Ltd.), PCM type two-axis extruders (manufactured by Ikegai Corporation), KEX type two-axis extruders (manufactured by Kurimoto, Ltd.); continuous single-axis extruders such as KO-KNEADER (manufactured by Buss AG); and the like kneaders.

The thus kneaded toner constituents (hereinafter the mixture) are cooled and then pulverized to prepare a mother toner. When pulverizing, the kneaded mixture is typically crushed by a hammer mill or ROTOPLEX and then pulverized by an air pulverizer or a mechanical pulverizer. The pulverization is preferably performed such that the average particle diameter of the pulverized mixture is from 3 to 15 μm. Then the pulverized mixture is air-classified to prepare a mother toner such that the particle diameters of the mother toner particles fall in a range of from 5 to 20 μm.

Then the mother toner is mixed with an external additive using a mixer while being agitated. In this process, the external additive covers the surface of the mother toner particles while being dissociated. It is important to uniformly and strongly adhere the external additive, such as inorganic particulate materials and particulate resins, on the surface of the mother toner particles to produce a toner having good durability.

Then the image forming method of the present invention will be explained referring to drawings.

FIG. 1 is a schematic view illustrating a fixer 100 useful for the image forming method and apparatus of the present invention.

In FIG. 1, R1, R2, R3 and R4 denote a fixing roller, a pressure roller, a heat roller and an oil applying roller, respectively. In addition, B, P, G, H, Pa and T denote a fixing belt, a pressure spring, a paper guide, a heater, a receiving paper and a toner image, respectively.

In this fixer 100, the toner image T on the receiving paper Pa, which is fed along the paper guide G, is fixed by being heated with the fixing belt B heated by the heat roller R3 while pressed by the pressure roller R2 toward the fixing roller R1. The fixing belt B is supported by the heat roller R3 and the fixing roller R1 while being rotated in a direction as indicated by an arrow. The oil applying roller applies a small amount of an oil on the fixing belt B. The oil applying roller is not necessarily needed.

Figure 2:
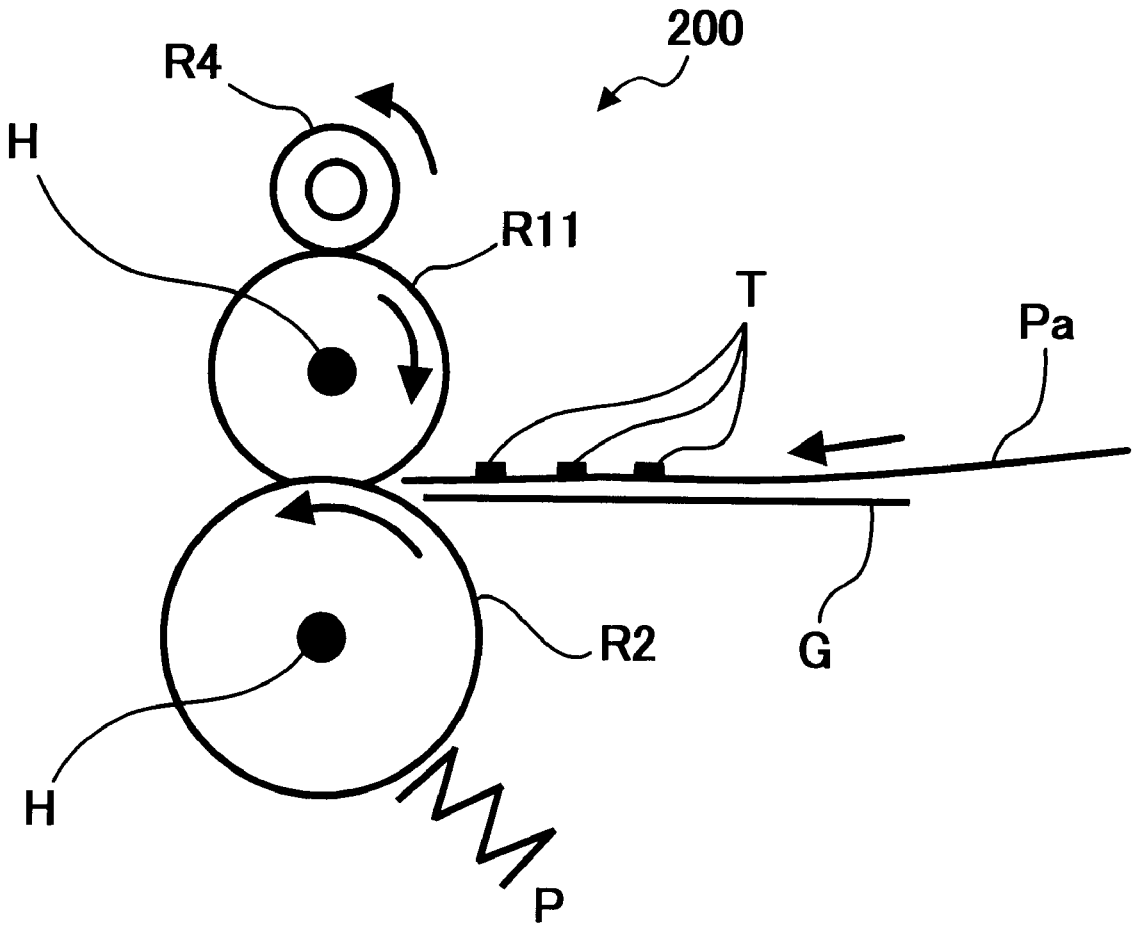
FIG. 2 is a schematic view illustrating the sectional view of another fixer using a fixing roller for use in the image forming apparatus of the present invention.

FIG. 2 is a schematic view illustrating another fixer 200 useful for the image forming method and apparatus of the present invention. In the fixer 200, a numeral R11 denotes a heated fixing roller having a heater H therein and rotating in a direction indicated by an arrow. A toner image T on the receiving paper Pa, which is fed along a paper guide G, is fixed by being heated with the fixing roller R11 while pressed by the pressure roller R2.

The fixing method of the present invention is a contact-heating fixing method. The surface of the fixing belt B (or the surface of the fixing roller R11) has high smoothness and good toner releasability. A release oil is not applied to the belt B or the small-amount-oil applicator R4 is provided in the fixer. Specifically, the surface of the fixing belt B (or the surface of the fixing roller R11) is made of a material having low surface energy such as fluorine-containing resins and rubbers, and silicone resins and rubbers.

At the nip section between the fixing belt B (or the fixing roller R11) and the pressure roller R2, the fixing belt B (or the fixing roller R11) is caved in to prevent the offset problem and a problem in which the receiving paper is caught by the fixing belt B (or the fixing roller R11). When the fixing belt B is used, it is preferable that the fixing roller R1 also has a heat-resistant elastic layer so as to be also caved in at the nip section. Since the fixing roller R11, the fixing belt B or both the fixing belt B and the fixing roller R1 deform like a shape of U at the nip section, the releasability of the toner image from the fixing roller R11 or the fixing belt B is increased; and the receiving paper Pa is discharged at a relatively large peeling angle from the fixing roller R11 or the fixing belt B.

In order that the fixing belt B or the fixing roller R11 is caved in at the nip section between the fixing belt B (or the fixing roller R11) and the pressure roller R2, the fixing roller R11 and the fixing belt B are preferably made of a heat-resistant elastic material or have a heat-resistant elastic layer. It is important that the hardness of the fixing roller R11 and the fixing belt B is lower than that of the pressure roller R2.

Figure 3:
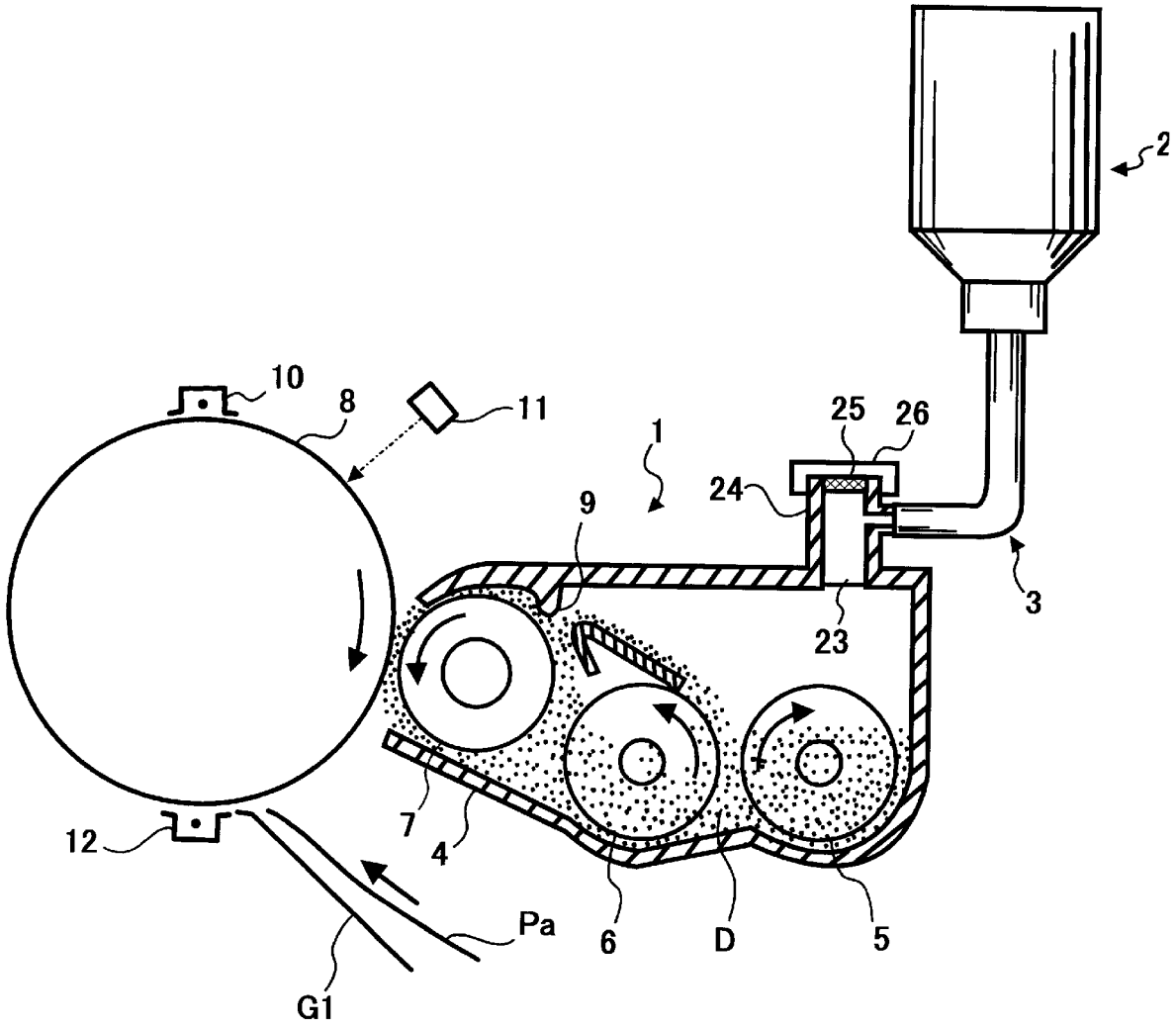
FIG. 3 is a schematic view illustrating the sectional view of the developing section of an embodiment of the image forming apparatus of the present invention.

FIG. 3 is a schematic view illustrating a developing section of an embodiment of the image forming apparatus of the present invention.

In FIG. 3, numerals 1, 2 and 3 denote an image developer, a toner container 2 containing the toner of the present invention to be supplied and a toner feeder configured to feed the toner to the image developer 1, respectively.

The image developer 1 includes a housing 4 in which a developer D including a carrier and the toner of the present invention is contained, a first agitator 5, a second agitator 6 and a developing roller 7. The developing roller 7 faces a photoreceptor (i.e., an image bearing member) 8. The photoreceptor 8 is rotated in a direction as indicated by an arrow, and bears an electrostatic latent image on the surface thereof.

A numeral 26 denotes a cap connected with a connector 24 with or without a filter 25 therebetween.

Around the photoreceptor 8, a charger 10, a light irradiator 11, and an image transfer device 12 are arranged. Other members such as a discharger, a cleaner, etc., which are not shown in FIG. 3, may be arranged.

The photoreceptor 8 is charged with the charger 10 and then exposed to imagewise light emitted by the light irradiator 11. Thus an electrostatic latent image is formed on the photoreceptor 8.

On the other hand, in the image developer 1 each of the agitators 5 and 6 rotates in a direction indicated by a respective arrow to agitate the developer D, and thereby the carrier and the toner are frictionally charged such that they have charges having different polarities. The thus charged developer D is supplied on the surface of the developing roller 7 and held thereon. Since the developing roller 7 rotates in a direction indicated by an arrow, the developer D on the developing roller 7 is regulated by a doctor blade 9 to form a thin layer of the developer D.

The thus formed developer layer is fed to the developing section at which the electrostatic latent image on the photoreceptor 8 is developed with the toner included in the developer layer, resulting in formation of a toner image on the photoreceptor 8.

Then the toner image formed on the photoreceptor 8 is transferred on a receiving material Pa, which is fed along a paper guide G1 in a direction as indicated by an arrow, by an image transfer device 12, and then the toner image on the receiving material Pa is fixed with a fixer such as the fixer 100 or 200.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following components were mixed with a blender to prepare a mixture of toner constituents.

| | |
|---|---|
| Polyester resin (A1)<br>(content of THF-insoluble components of 0%, weight average molecular weight (Mw) of 17000, glass transition temperature (Tg) of 59° C. and solubility parameter (SP) of 10.8) | 80 |

-continued

| | |
|---|---|
| Styrene-methyl acrylate copolymer (B1)<br>(content of THF-insoluble components of 0%, Mw of 15000, Tg of 62° C. and SP of 9.3) | 15 |
| Polyethylene wax (W1)<br>(melting point of 99° C., penetration of 1.5 and SP of 8.1) | 5 |
| Charge controlling agent (CCA1)<br>(a metal salt of a salicylic acid derivative) | 2 |
| Colorant (C1)<br>(copper phthalocyanine blue pigment) | 2.5 |

The resin B1 could be pulverized more easily than the resin A1 and the wax W1 (i.e., the resin B1 had better pulverizability than the resin A and the wax W1.

Then the mixture was kneaded with a two-axis extruder while being heated. Next, the kneaded mixture was cooled and then pulverized and classified. Thus, a cyan mother toner having a volume average particle diameter 7.5 $\mu$m.

The following components were mixed with a Henshel mixer to prepare a cyan toner.

| | |
|---|---|
| Mother toner prepared above | 100 |
| External additive<br>(hydrophobized silica whose surface was treated with hexamethyldisilazane and which has an average primary particle diameter of 0.02 $\mu$m) | 0.4 |

The content of THF-insoluble components in the resins included in the thus prepared toner was 0%. In addition, the maximum particle diameter of the toner was 18 $\mu$m, and the maximum major-axis particle diameter of the wax in the toner was 7 $\mu$m. Further, when the toner was observed with a transmission electron microscope, the resin B1 was dispersed like islands in a sea of the resin A1 and in addition the wax was included in the resin B1.

Five (5) parts of the thus prepared toner were mixed with 95 parts of a carrier which was coated with a silicone resin, and the mixture was agitated to prepare a two-component developer.

The developer was evaluated as follows:

(1) Gloss of Toner Image

Fixed toner images were produced on a plain paper type 6000<70 W for full color recording manufactured by Ricoh Co., Ltd. using a modified color copier PRETER 650 manufactured by Ricoh Co., Ltd., in which a roller covered with a PFA (perfluoroalkylvinyl ether) tube is used as a fixing roller, and the silicone-oil applicator was removed therefrom. The fixing roller includes a silicone rubber layer of 2 mm thick which is covered with a PFA tube of 25 $\mu$m thick. The fixing pressure was 80 Kg, and the nip width was 8 mm. The fixing roller was caved in at the nip section. In addition, the power of the heater inside the heating roller was 650 W and the power of the heater inside the pressure roller was 400 W.

In addition, the modified copier was adjusted such that a toner image having a weight of 1.0±0.1 mg/cm$^2$.

The gloss of a toner image fixed by the fixing roller whose temperature was 160° C. was measured using a gloss meter manufactured by Nippon Denshoku Kogyo K.K., in which the incident angle of the light was 60°.

With respect to gloss, the larger the value of gloss of a toner image, the glossier the toner image. In order to obtain a toner image having good sharpness and good color reproducibility, the gloss is preferably not less than about 10%.

(2) Offset Resistance

Fixed toner images were reproduced using the modified color copier PRETER 650 while increasing the temperature of the fixing roller at intervals of 5° C. to determine the temperature at which the offset problem occurred. No oil was applied to the fixing roller and the plain paper type 6000<70 W was also used as the receiving material.

The offset resistance was evaluated as follows:

◎: the offset problem did not occur even at a very high fixing temperature

○: the offset problem did not occur even at a high fixing temperature

Δ: the offset resistance was unsatisfactory, however, when a small amount (0.5 to 1 mg/A4 size) of a silicone oil was applied to the fixing roller, good offset resistance could be exerted)

X: the offset problem occurred at a relatively low fixing temperature, and in addition the offset resistance could not be improved even when a small amount of a silicone oil was applied to the fixing roller)

(3) Transferability

A toner image was produced on the intermediate transfer belt of the modified color copier PRETER 650. Just after the toner image on the intermediate transfer belt was transferred on a full color plain paper type 6000<70 W, the operations of the copier was suddenly stopped to check the quantity of the toner remaining on the intermediate transfer belt. The transferability was evaluated as follows:

◎: the quantity of the remaining toner was very little

○: the quantity of the remaining toner was a little

Δ: the transferability was the same as that of the conventional color toner including a wax X: the quantity of the remaining toner was very much (4) Durability Fifty thousand (50,000) copies of a test chart having an image area of 10% were reproduced using the modified color copier PRETER 650. The charge quantity of the toner was measured before and after the running test to compare them. The durability was evaluated as follows:

◎: the charge quantity hardly decreased

○: the charge quantity slightly decreased

Δ: the decrease of the charge quantity was almost the same as that of a conventional color toner including a wax X: the charge quantity seriously decreased (5) Charge Stability when the Humidity Changes A two component developer was prepared under an environmental conditions of 10° C. and 15% RH. The charge quantity (L $\mu$C/g) of the developer was measured by a blow-off method. The procedure was repeated except that the environmental condition was changed to 30° C. and 90% RH to determine the charge quantity (H $\mu$C/g). The charge changing rate is defined as follows:

$$\text{Charge changing rate}=\{2(L-H)/(L+H)\}\times 100(\%)$$

The charge stability was evaluated as follows:

◎: charge changing rate was not greater than 20%

○: charge changing rate was from 21 to 40%

Δ: charge changing rate was from 41 to 70%

X: charge changing rate was not less than 71%

The charge changing rate is preferably not greater than 40% and more preferably not greater than 20%.

(6) Toner Construction

Toner particles were embedded in an epoxy resin and an ultrathin section of a toner particle was prepared. The ultrathin section was observed with a transmission electron microscope after dyed with $RuO_4$.

The results are shown in Table 1.

As can be understood from Table 1, the toner of Example 1 has good offset resistance, transferability, durability, charge stability and pulverizability while providing glossy images.

Example 2

The procedure for preparation of the toner in Example 1 was repeated except that the formulation of the toner was changed as follows:

| | |
|---|---|
| Polyester resin (A1) | 90 |
| Styrene-methyl acrylate copolymer (B1) | 8 |
| Polyethylene wax (W1) | 2 |
| Charge controlling agent (CCA1) | 2 |
| Colorant (C1) | 2.5 |

The content of the THF-insoluble components in the toner was 0%. In addition, the maximum particle diameter of the toner was 18 $\mu$m, and the maximum major-axis particle diameter of the wax W1 in the toner was 5 $\mu$m. Further, when the toner was observed with a transmission electron microscope, the resin B1 was dispersed like islands in a sea of the resin A1 and in addition the wax W1 was included in the resin B1.

Five (5) parts of the thus prepared toner was mixed with 95 parts of a silicone-resin-coated carrier to prepare a two-component developer.

The thus prepared toner and developer were evaluated by the same method performed in Example 1. The results are shown in Table 1.

As can be understood from Table 1, the toner has excellent transferability and durability. In addition, the toner has good charge stability and pulverizability, however the offset resistance is not good but is still acceptable. Therefore it can be said that if the content of the wax is further decreased, the object of the present invention cannot be attained.

Example 3

The procedure for preparation of the toner in Example 1 was repeated except that the formulation of the toner was changed as follows:

| | |
|---|---|
| Polyester resin (A1) | 55 |
| Styrene-methyl acrylate copolymer (B1) | 30 |
| Polyethylene wax (W1) | 15 |
| Charge controlling agent (CCA1) | 2 |
| Colorant (C1) | 2.5 |

The content of the THF-insoluble components in the toner was 0%. In addition, the maximum particle diameter of the toner was 18 $\mu$m, and the maximum major-axis particle diameter of the wax W1 in the toner was 9 $\mu$m. Further, when the toner was observed with a transmission electron microscope, the resin B1 was dispersed like islands in a sea of the resin A1 and in addition the wax W1 was included in the resin B1.

Five (5) parts of the thus prepared toner was mixed with 95 parts of a silicone-resin-coated carrier to prepare a two-component developer.

The thus prepared toner and developer were evaluated by the same method performed in Example 1. The results are shown in Table 1.

As can be understood from Table 1, the toner has excellent offset resistance, charge stability and pulverizability. However the transferability and durability are not good but are still acceptable. Therefore it can be said that if the content of the wax is further increased, the object of the present invention cannot be attained.

Example 4

The procedure for preparation of the toner in Example 1 was repeated except that the formulation of the toner was changed as follows:

| | |
|---|---|
| Polyester resin (A1) | 80 |
| Styrene-butyl acrylate copolymer (B2) (content of THF-insoluble components of 0%, Mw of 15000, Tg of 61° C. and SP of 9.0) | 15 |
| Carnauba wax which had been subjected to a free-fatty acid removing treatment (W2) (melting point of 83° C., penetration of 1 and SP of 8.9) | 5 |
| Charge controlling agent (CCA1) | 2 |
| Colorant (C1) | 2.5 |

The resin B2 could be pulverized more easily than the resin A1 and wax W2.

The content of the THF-insoluble components in the toner was 0%. In addition, the maximum particle diameter of the toner was 18 μm, and the maximum major-axis particle diameter of the wax W2 in the toner was 2 μm. Further, when the toner was observed with a transmission electron microscope, the resin B2 was dispersed like islands in a sea of the resin A1 and in addition the wax W2 was included in the resin B2.

Five (5) parts of the thus prepared toner was mixed with 95 parts of a silicone-resin-coated carrier to prepare a two-component developer.

The thus prepared toner and developer were evaluated by the same method performed in Example 1. The results are shown in Table 1.

As can be understood from Table 1, the toner has excellent transferability and durability while producing high glossy images. In addition, the toner has good offset resistance, pulverizability, and charge stability.

Example 5

The procedure for preparation of the toner in Example 1 was repeated except that the formulation of the toner was changed as follows:

| | |
|---|---|
| Polyester resin (A2) (content of THF-insoluble components of 0%, Mw of 45000, Tg of 60° C. and SP of 10.7) | 60 |
| Styrene-butyl acrylate copolymer (B2) | 35 |
| Carnauba wax which had been subjected to a free-fatty acid removing treatment (W2) | 5 |
| Charge controlling agent (CCA1) | 2 |
| Colorant (C1) | 2.5 |

The resin B2 could be pulverized more easily than the resin A2 and wax W2.

The content of the THF-insoluble components in the toner was 0%. In addition, the maximum particle diameter of the toner was 18 μm, and the maximum major-axis particle diameter of the wax in the toner was 1.5 μm. Further, when the toner was observed with a transmission electron microscope, the resin B2 was dispersed like islands in a sea of the resin A2 and in addition the wax W2 was included in the resin B2.

Five (5) parts of the thus prepared toner was mixed with 95 parts of a silicone-resin-coated carrier to prepare a two-component developer.

The thus prepared toner and developer were evaluated by the same method performed in Example 1. The results are shown in Table 1.

As can be understood from Table 1, the toner has excellent offset resistance, transferability, durability and charge stability although the resultant images have low gloss. When images were produced under the recording conditions below-mentioned, the gloss was increased to 21%.

Fixing speed: half of the standard speed

Copy mode: thick paper copy mode

Namely, this toner can selectively produce matted images or glossy images by changing recording conditions.

Example 6

The procedure for preparation of the toner in Example 1 was repeated except that the formulation of the toner was changed as follows:

| | |
|---|---|
| Polyester resin (A3) (content of THF-insoluble components of 0%, Mw of 12000, Tg of 59° C. and SP of 10.8) | 70 |
| Polyester resin (A4) (content of THF-insoluble components of 0%, Mw of 48000, Tg of 59° C. and SP of 11.3) | 10 |
| Styrene-butyl acrylate copolymer (B2) | 15 |
| Carnauba wax which had been subjected to a free-fatty acid removing treatment (W2) | 5 |
| Charge controlling agent (CCA1) | 2 |
| Colorant (C1) | 2.5 |

The resin B2 could be pulverized more easily than the resins A3 and A4 and the wax W2.

The content of the THF-insoluble components in the toner was 0%. In addition, the maximum particle diameter of the toner was 18 μm, and the maximum major-axis particle diameter of the wax W2 in the toner was 2 μm. Further, when the toner was observed with a transmission electron microscope, the resin B2 was dispersed like islands in a sea of the resins A3 and A4 and in addition the wax W2 was included in the resin B2.

Five (5) parts of the thus prepared toner was mixed with 95 parts of a silicone-resin-coated carrier to prepare a two-component developer.

The thus prepared toner and developer were evaluated by the same method performed in Example 1. The results are shown in Table 1.

As can be understood from Table 1, the toner has better offset resistance than the toner of Example 4, while the resultant images have gloss as high as that of the images produced by the toner of Example 4.

Example 7

The procedure for preparation of the mother toner in Example 1 was repeated.

The following components were mixed with a Henshel mixer to prepare a cyan toner.

| | |
|---|---|
| Mother toner prepared above | 100 |
| Hydrophobized silica (Hydrophobizing agent: hexamethyldisilazane) | 0.4 |
| Hydrophobized titanium oxide (Hydrophobizing agent: isobutyltrimethoxysilane) | 0.6 |

Five (5) parts of the thus prepared toner was mixed with 95 parts of a silicone-resin-coated carrier to prepare a two-component developer.

The thus prepared toner and developer were evaluated by the same method performed in Example 1. The results are shown in Table 1.

As can be understood from Table 1, the toner has better transferability and charge stability than the toner of Example 1.

Example 8

The procedures for preparation and evaluation of the toner in Example 1 were repeated except that the polyester resin A1 was replaced with a polyol resin A1.

The polyol resin A5 was synthesized using bisphenol-A-form epoxy resin, a glycidyl compound of an adduct of ethylene oxide with bisphenol A, bisphenol F, and p-cumylphenol. The content of THF-insoluble components in the resin A5 is 0%, and Mw, Tg and SP of the resin A5 are 18,000, 60° C. and 11.1.

The maximum particle diameter of the toner was 18 μm, and the maximum major-axis particle diameter of the wax in the toner was 5 μm. When the toner was observed with a transmission electron microscope, the resin B1 was dispersed like islands in a sea of the resin A5 and in addition the wax W1 was included in the resin B1.

As can be understood from Table 1, the toner has good transferability, durability, charge stability, pulverizability and offset resistance while the resultant images have high gloss.

Example 9

The procedures for preparation and evaluation of the toner in Example 1 were repeated except that the resin B1 was replaced with a resin B3 which was prepared by grafting a styrene-butyl acrylate-acrylonitrile copolymer on a polyethylene wax.

The content of THF-insoluble components in the resin B3 is 0%, and Mw, Tg and SP of the resin B3 are 15,000, 63° C. and 10.2.

The maximum particle diameter of the toner was 18 μm, and the maximum major-axis particle diameter of the wax W1 in the toner was 1 μm. When the toner was observed with a transmission electron microscope, the resin B3 was dispersed like islands in a sea of the resin A1 and in addition the wax W1 was included in the resin B3.

As can be understood from Table 1, the toner has good transferability, durability, charge stability, pulverizability and offset resistance while the resultant images have high gloss. In particular, the toner has excellent transferability and durability.

Example 10

The procedures for preparation and evaluation of the toner in Example 9 were repeated except that the wax W1 was replaced with a synthesized ester wax W3. The melting point, penetration and solubility parameter (SP) of the wax W3 are 84° C., 1 and 8.8, respectively.

The content of THF-insoluble components in the resins is 0%. In addition, the maximum particle diameter of the toner was 18 μm, and the maximum major-axis particle diameter of the wax W3 in the toner was 0.7 μm. When the toner was observed with a transmission electron microscope, the resin B3 was dispersed like islands in a sea of the resin A1 and in addition the wax W3 was included in the resin B3.

As can be understood from Table 1, the toner has good transferability, durability, charge stability, pulverizability and offset resistance while the resultant images have high gloss. In particular, the toner has excellent transferability and durability.

Example 11

The procedures for preparation and evaluation of the toner in Example 10 were repeated except that the addition quantity of the resin B3 was changed from 15 parts to 20 parts and the addition quantity of the synthesized ester wax W3 was changed from 5 parts to 3 parts.

The content of THF-insoluble components in the resins is 0%. In addition, the maximum particle diameter of the toner was 18 μm, and the maximum major-axis particle diameter of the wax in the toner was 0.3 μm. When the toner was observed with a transmission electron microscope, the resin B3 was dispersed like islands in a sea of the resin A1 and in addition the wax W3 was included in the resin B3.

As can be understood from Table 1, the toner has better transferability and durability than the toner of Example 10. However, the offset resistance of the toner is worse than that of the toner of Example 10, but is still acceptable.

Example 12

The procedures for preparation and evaluation of the toner in Example 1 were repeated except that the formulation of the mother toner is changed as follows:

| | |
|---|---|
| Polyester resin (A1) | 80 |
| Styrene-methyl acrylate copolymer (B1) | 15 |
| Polyethylene wax (W1) | 5 |
| Charge controlling agent (CCA1) | 2 |
| Colorant (C1) | 2.5 |
| Hydrophobized silica (average primary particle diameter of 0.02 μm) (Hydrophobized agent: hexamethyldisilazane) | 1.5 |
| Particulate polymethyl methacrylate resin (prepared by a soap-free emulsion polymerization method and having an average primary particle diameter of 0.2 μm) | 3 |

The results are shown in Table 1.

As can be understood from Table 1, the toner has good transferability, durability, offset resistance, charge stability and pulverizability while the resultant images have high gloss. In particular, the transferability and durability are better than those of the toner of Example 1.

Example 13

The procedures for preparation and evaluation of the toner in Example 7 were repeated except that 1.2 parts of a silica having a surface area of 35 $m^2/g$ were further added as an external additive.

As can be understood from Table 1, the toner has good transferability, durability, offset resistance, charge stability and pulverizability while the resultant images have high gloss. In particular, the durability is better than that of the toner of Example 7.

Example 14

The procedures for preparation and evaluation of the toner in Example 7 were repeated except that 2 parts of a particulate polymethyl methacrylate, which were prepared by a soap-free emulsion polymerization method and had an average primary particle diameter of 0.2 μm, were further added as an external additive.

As can be understood from Table 1, the toner has good transferability, durability, offset resistance, charge stability and pulverizability while the resultant images have high gloss. In particular, the durability is better than that of the toner of Example 7.

Example 15

The procedures for preparation and evaluation of the toner in Example 14 were repeated except that the wax W1 was replaced with a polyethylene wax (W4) having a melting point of 88° C. and a penetration of 6.5.

The content of THF-insoluble components in the resins is 0%. In addition, the maximum particle diameter of the toner was 18 μm, and the maximum major-axis particle diameter of the wax in the toner was 8 μm. When the toner was observed with a transmission electron microscope, the resin B1 was dispersed like islands in a sea of the resin A1 and in addition the wax W4 was included in the resin B1.

The results are shown in Table 1.

As can be understood from Table 1, the toner has good transferability, durability, offset resistance, charge stability and pulverizability while the resultant images have high gloss. However, the transferability and durability are slightly worse than those of the toner of Example 14.

Example 16

The procedures for preparation and evaluation of the toner in Example 1 were repeated except that the modified color copier PRETER 650 had a fixer having the same construction as shown in FIG. 1 except that the roll R4 is removed therefrom.

The conditions of the fixer are as follows:

(1) The fixing roller has a diameter of 38 mm and is made of a foamed silicone resin;
(2) The pressure roller has a diameter of 50 mm, and has a silicone rubber layer having a thickness of 1 mm which is covered with a PFA tube;
(3) The heat roller has a diameter of 30 mm and is made of an aluminum cylinder having a thickness of 2 mm;
(4) The fixing belt has a diameter of 60 mm and includes a substrate of a nickel belt having a thickness of about 40 μm and a release layer on the substrate, in which a silicone rubber layer having a thickness of about 150 μm is covered with a PFA layer having a thickness of 20 μm;
(5) Belt tension: 1.5 kg/(one side) (i.e., 3.0 kg/(width of the belt));
(6) Belt speed: 180 mm/sec;
(7) Nip width: 10 mm;
(8) Power of heater in fixing roller: 650 W;
(9) Power of heater in pressure roller: 400 W;
(10) Fixing pressure (total pressure): 40 Kg; and
(11) Fixing temperature (preset temperature): 150° C. (temperature of fixing belt)

Comparative Example 1

The procedure for preparation of the toner in Example 1 was repeated except that the formulation of the toner was changed as follows:

| | |
|---|---|
| Polyester resin (A1) | 95 |
| Polyethylene wax (W1) | 5 |
| Charge controlling agent (CCA1) | 2 |
| Colorant (C1) | 2.5 |

Namely, this toner has a formulation in which the resin B1 is not added and the addition quantity of the resin A1 is changed from 80 to 95 parts in the formulation of Example 1.

The content of the THF-insoluble components in the toner was 0%. In addition, the maximum particle diameter of the toner was 18 μm, and the maximum major-axis particle diameter of the wax W1 in the toner was 9 μm. Further, when the toner was observed with a transmission electron microscope, the wax W1 was dispersed like islands in a sea of the resin A1. In addition, the particle diameter of the wax W1 dispersed in the resin A1 was larger than that of the wax W1 dispersed in the resin B1 in the toner of Example 1.

Five (5) parts of the thus prepared toner was mixed with 95 parts of a silicone-resin-coated carrier to prepare a two-component developer.

The thus prepared toner and developer were evaluated by the same method performed in Example 1. The results are shown in Table 1.

As can be understood from Table 1, the toner has poor transferability, durability, pulverizability and charge stability.

Comparative Example 2

The procedure for preparation of the toner in Example 1 was repeated except that the formulation of the toner was changed as follows:

| | |
|---|---|
| Polyester resin (A1) | 65 |
| Styrene-methyl acrylate copolymer (B1) | 15 |
| Polyethylene wax (W1) | 20 |
| Charge controlling agent (CCA1) | 2 |
| Colorant (C1) | 2.5 |

Namely, the content of the wax W1 in this toner is much greater than in the toner of Example 1.

The content of the THF-insoluble components in the toner was 0%. In addition, the maximum particle diameter of the toner was 18 μm, and the maximum major-axis particle diameter of the wax W1 in the toner was 10 μm. Further, when the toner was observed with a transmission electron microscope, the resin B1 was dispersed like islands in a sea of the resin A1 and in addition the wax W1 was dispersed in both the resins A1 and B1.

Five (5) parts of the thus prepared toner was mixed with 95 parts of a silicone-resin-coated carrier to prepare a two-component developer.

The thus prepared toner and developer were evaluated by the same method performed in Example 1. The results are shown in Table 1.

As can be understood from Table 1, the toner has poor transferability and durability although the toner has good offset resistance.

Comparative Example 3

The procedure for preparation of the toner in Example 1 was repeated except that the formulation of the toner was changed as follows:

| | |
|---|---|
| Polyester resin (A6) (content of THF-insoluble components of 0%, Mw of 7000, Tg of 60° C. and SP of 10.8) | 85 |
| Styrene-methyl acrylate copolymer (B1) | 15 |
| Polyethylene wax (W1) | 5 |
| Charge controlling agent (CCA1) | 2 |
| Colorant (C1) | 2.5 |

Namely, this toner is that the polyester resin A1 in the toner of Example 1 was replaced with a low molecular weight polyester resin A6.

The content of the THF-insoluble components in the toner was 0%. In addition, the maximum particle diameter of the toner was 18 μm, and the maximum major-axis particle diameter of the wax W1 in the toner was 8 μm. Further, when the toner was observed with a transmission electron microscope, the resin B1 was dispersed like islands in a sea of the resin A6 and in addition the wax W1 was included in the resin B1.

Five (5) parts of the thus prepared toner was mixed with 95 parts of a silicone-resin-coated carrier to prepare a two-component developer.

The thus prepared toner and developer were evaluated by the same method performed in Example 1. The results are shown in Table 1.

As can be understood from Table 1, the toner has poor offset resistance.

Comparative Example 4

The procedure for preparation of the toner in Example 1 was repeated except that the formulation of the toner was changed as follows:

| | |
|---|---|
| Polyester resin (A7) (content of THF-insoluble components of 2%, Mw of 100,000, Tg of 61° C. and SP of 10.8) | 85 |
| Styrene-methyl acrylate copolymer (B1) | 15 |
| Polyethylene wax (W1) | 5 |
| Charge controlling agent (CCA1) | 2 |
| Colorant (C1) | 2.5 |

Namely, this toner is that the polyester resin A1 in the toner of Example 1 was replaced with a polyester resin A7 including THF-insoluble components in an amount of 2% by weight.

The content of the THF-insoluble components in the resins in the toner was 1%. In addition, the maximum particle diameter of the toner was 18 μm, and the maximum major-axis particle diameter of the wax W1 in the toner was 5 μm. Further, when the toner was observed with a transmission electron microscope, the resin B1 was dispersed like islands in a sea of the resin A7 and in addition the wax W1 was included in the resin B1.

Five (5) parts of the thus prepared toner was mixed with 95 parts of a silicone-resin-coated carrier to prepare a two-component developer.

The thus prepared toner and developer were evaluated by the same method performed in Example 1. The results are shown in Table 1.

As can be understood from Table 1, the toner has excellent offset resistance, however, the resultant images have low gloss. Even when the fixing temperature was increased by 10° C., and the fixing speed was decreased to one half of the standard speed, glossy images could not be produced.

Comparative Example 5

The procedures for preparation and evaluation of the toner in Example 1 was repeated except that the external additive was not added.

The results are shown in Table 1. The toner of Comparative Example 5 has poor transferability and durability.

Comparative Example 6

The procedure for preparation of the toner in Example 1 was repeated except that the formulation of the toner was changed as follows:

| | |
|---|---|
| Styrene-butyl acrylate copolymer (A8) (content of THF-insoluble components of 0%, Mw of 19,000, Tg of 60° C., and SP of 9.0) | 85 |
| Styrene-methyl acrylate copolymer (B1) | 15 |
| Polyethylene wax (W1) | 5 |
| Charge controlling agent (CCA1) | 2 |
| Colorant (C1) | 2.5 |

Namely, this toner is that the polyester resin A1 in the toner of Example 1 was replaced with a styrene-acrylate copolymer A8.

The content of the THF-insoluble components in the toner was 0%. In addition, the maximum particle diameter of the toner was 18 μm, and the maximum major-axis particle diameter of the wax W1 in the toner was 3 μm. Further, when the toner was observed with a transmission electron microscope, the wax W1 was dispersed like islands in a sea in which the resins A8 and B1 are perfectly mixed with each other.

Five (5) parts of the thus prepared toner was mixed with 95 parts of a silicone-resin-coated carrier to prepare a two-component developer.

The thus prepared toner and developer were evaluated by the same method performed in Example 1. The results are shown in Table 1.

As can be understood from Table 1, the toner has better pulverizability and charge stability than the toner of Example 1, however, the offset resistance, transferability and durability are worse than those of the toner of Example 1.

TABLE 1

| | Gloss (%) | Offset resistance | Transferability | Durability | Pulverizability | Charge stability |
|---|---|---|---|---|---|---|
| Ex. 1 | 25 | ○ | ○ | ○ | ○ | ○ |
| Ex. 2 | 31 | Δ | ◎ | ◎ | ○ | ○ |
| Ex. 3 | 18 | ◎ | Δ | Δ | ◎ | ◎ |
| Ex. 4 | 27 | ○ | ◎ | ◎ | ○ | ○ |
| Ex. 5 | 5 | ◎ | ◎ | ◎ | ○ | ◎ |
| Ex. 6 | 27 | ◎ | ◎ | ◎ | ○ | ○ |
| Ex. 7 | 24 | ○ | ◎ | ○ | ○ | ◎ |
| Ex. 8 | 25 | ○ | ○ | ○ | ○ | ○ |
| Ex. 9 | 28 | ○ | ◎ | ◎ | ○ | ○ |
| Ex. 10 | 26 | ○ | ◎ | ◎ | ○ | ○ |
| Ex. 11 | 27 | Δ | ◎ | ◎ | ○ | ○ |

TABLE 1-continued

| | Gloss (%) | Offset resist-ance | Transfer-ability | Dura-bility | Pulveliz-ability | Charge stability |
|---|---|---|---|---|---|---|
| Ex. 12 | 25 | ○ | ◎ | ◎ | ○ | ○ |
| Ex. 13 | 23 | ○ | ◎ | ◎ | ○ | ◎ |
| Ex. 14 | 21 | ○ | ◎ | ◎ | ○ | ◎ |
| Ex. 15 | 21 | ○ | ○ | ○ | ○ | ◎ |
| Ex. 16 | 20 | ○ | ○ | ○ | ○ | ○ |
| Comp. Ex. 1 | 39 | ○ | X | X | X | X |
| Comp. Ex. 2 | 15 | ◎ | X | X | ○ | ○ |
| Comp. Ex. 3 | 51 | X | ○ | ○ | ○ | ○ |
| Comp. Ex. 4 | 1.3 | ◎ | ○ | ○ | ○ | ○ |
| Comp. Ex. 5 | 26 | ○ | X | X | ○ | ○ |
| Comp. Ex. 6 | 19 | X | Δ | Δ | ◎ | ◎ |

Effects of the Invention

The toner of the present invention includes at least a colorant, two resins A and B, and a wax, wherein the resins and wax are incompatible with the others and have an island-sea structure in which the resin B is present as islands in a sea of the resin A and the wax is dispersed in the resin B. Accordingly, the quantity of the wax present on the surface of the toner is decreased, and therefore a relatively large amount of wax can be included in the toner, thereby improving the offset resistance of the resultant toner. In addition, although conventional wax-containing toners typically have poor transferability and durability, the toner of the present invention has good transferability and durability. Further, the toner also has good pulverizability, and therefore a toner having a small particle diameter can be produced high efficiently.

In addition, the resin A does not include THF-insoluble components and has a weight average molecular weight of from 10,000 to 90,000, and therefore the resultant toner images have a high gloss and good color reproducibility.

Further, at least one of particulate inorganic materials and particulate resins is included as an external additive, the resultant toner has good transferability and durability.

The toner of the present invention has good offset resistance when the following relationship is satisfied:

$$SP_A > SP_B > SP_W$$

wherein $SP_A$, $SP_B$ and $SP_W$ represents the solubility parameters of the resins A and B and the wax, respectively.

The toner of the present invention has good transferability and durability and high productivity when the difference in solubility parameter between the resin A and the resin B is 0.6 or greater. This is because the island-sea structure is securely formed, and the quantity of the resins A and B present on the surface of the toner can be increased (i.e., the quantity of the wax present on the surface of the toner can be decreased).

The toner of the present invention has good offset resistance, transferability, durability, pulverizability, and charge stability when the contents of the resin A, resin B and wax are respectively from 55 to 96% by weight, from 2 to 44% by weight, and from 2 to 44% by weight based on total of the resins A and B and the wax.

The toner of the present invention has good pulverizability and offset resistance when the resin B can be pulverized more easily than the resin A. This is because the possibility that the wax is present in a surface portion of the toner can be increased. In addition, when the resin B can be pulverized more easily than the wax, the transferability and durability of the resultant toner can be further improved.

The toner of the present invention has a well-balanced combination of offset resistance, transferability and durability when the maximum major-axis particle diameter of the wax dispersed in the toner is not less than 0.5 $\mu$m and not greater than one third of the maximum particle diameter of the toner.

The toner of the present invention has good offset resistance while producing images having a high gloss and good color reproducibility when the resin A includes at least one of a polyester resin and a polyol resin.

The toner of the present invention has good offset resistance while producing images having a high gloss when the resin A includes at least two resins which have different weight average molecular weights and whose solubility parameters are different by 0.4 to 0.6.

The toner of the present invention has good offset resistance while producing images having a high gloss and good color reproducibility when the resin B does not includes THF-insoluble components and has a weight average molecular weight of from 10,000 to 60,000.

The toner of the present invention has good transferability and durability when the resin B is a material in which a vinyl resin is grafted on a wax. This is because the wax is finely dispersed in the toner, and thereby the quantity of the wax present on the surface of the toner is decreased.

The toner of the present invention has good durability when the glass transition temperature (Tg) of the resin B is higher than that of the resin A. This is because the resin B tends to be present on the surface of the toner and has a high Tg, and thereby prevention of the spent tone problem can be avoided.

The toner of the present invention has good offset resistance, transferability and durability when the wax has a melting point of from 70 to 125° C.

The toner of the present invention has good offset resistance, transferability and durability when the wax includes at least one of carnauba wax, modified carnauba waxes and synthesized ester waxes. This is because such a wax is uniformly dispersed in the resin B while having a proper particle diameter.

The toner of the present invention has good transferability and durability when a particulate inorganic material and/or a particulate resin are included in the toner as an internal additive.

The charge stability can be further improved when the external additive includes a hydrophobized silica and a hydrophobized titanium oxide, wherein the content of the hydrophobized titanium oxide is greater than that of the hydrophobized silica.

In addition, when the hydrophobized silica includes a silica having an average primary particle diameter of from 0.01 to 0.03 $\mu$m and a silica having a surface area of from 20 to 50 $m^2/g$, the transferability and durability can be further improved.

The transferability and durability can be further improved when the average particle diameters of the hydrophobized silica and titanium oxide are not greater than one eighth of the average particle diameter of the toner.

In the image forming method of the present invention, since an image of the toner of the present invention on a receiving material is passed through the nip section between a heated fixing roller having a heat resistant elastic layer and a pressure roller at which the fixing roller is caved in like a character "U", the fixed toner image has a high gloss and good color reproducibility. In addition, even when an oil applicator is not used or a small-amount-oil applicator is used, the offset problem hardly occurs. When a fixing belt is used instead of the fixing roller, the same effects can be exerted.

Additional modifications and variations of the present invention are possible in light of the above teachings. It is therefore to be understood that within the scope of the appended claims the invention maybe practiced other than as specifically described herein.

This document claims priority and contains subject matter related to Japanese Patent Application No. 2000-191130, filed on Jun. 26, 2000, the entire contents of which are herein incorporated by reference.

What is claimed is:

1. A toner comprising:

mother toner particles comprising at least two resins A and B and a wax, wherein each of the resins A and B and the wax is incompatible with the others; and an external additive comprising at least one of a particulate inorganic material and a particulate resin, wherein the resins A and B and the wax form a sea-island structure in which the resin B is present as islands in a sea of the resin A and the wax is substantially included in the resin B while dispersed therein, and wherein the resin A does not include a component insoluble in tetrahydrofuran and has a weight average molecular weight of from 10,000 to 90,000.

2. The toner according to claim 1, wherein the resins A and B and the wax have different solubility parameters, SPa, SPb and SPw, respectively, and wherein the following relationship is satisfied:

$$SPa>SPb>SPw.$$

3. The toner according to claim 2, wherein SPa is 0.6 or more greater than SPb.

4. The toner according to claim 1, wherein the following relationship is satisfied:

$$Ca>Cb>Cw$$

wherein Ca, Cb and Cw represent weight ratios of the resins A and B and the wax, respectively, based on total weight of the resins A and B and the wax, and wherein Ca is from 0.55 to 0.96, Cb is from 0.02 to 0.44 and Cw is from 0.02 to 0.15.

5. The toner according to claim 1, wherein the resin B has better pulverizability than the resin A.

6. The toner according to claim 1, wherein the resin B has better pulverizability than the wax.

7. The toner according to claim 1, wherein the wax dispersed in the resin B has a maximum major-axis particle diameter not less than 0.5 $\mu$m and not greater than one third of a maximum particle diameter of the toner.

8. The toner according to claim 1, wherein the resin A comprises at least one of a polyester resin and a polyol resin.

9. The toner according to claim 1, wherein the resin A comprises at least two resins having different weight average molecular weights and different solubility parameters, and wherein a difference between the solubility parameters is from 0.4 to 0.6.

10. The toner according to claim 1, wherein the resin B does not include a component insoluble in tetrahydrofuran, and wherein the resin B has a weight average molecular weight of from 10,000 to 60,000.

11. The toner according to claim 1, wherein the resin B comprises a resin in which a vinyl resin is grafted on a wax.

12. The toner according to claim 1, wherein the resins A and B have different glass transition temperatures, and wherein the glass transition temperature of the resin B is higher than the glass transition temperature of the resin A.

13. The toner according to claim 1, wherein the wax has a melting point of from 70 to 125° C., and a penetration not greater than 5.

14. The toner according to claim 1, wherein the wax is selected from the group consisting of carnauba wax, modified carnauba waxes and synthesized ester waxes.

15. The toner according to claim 1, wherein the mother toner particles further comprise at least one of a particulate inorganic material or a particulate resin as an internal additive.

16. The toner according to claim 1, wherein the external additive comprises a hydrophobized silica and a hydrophobized titanium oxide, and wherein the hydrophobized titanium oxide is present in the toner in a greater amount than the hydrophobized silica.

17. The toner according to claim 16, wherein the hydrophobized silica comprises a first hydrophobized silica having an average primary particle diameter of from 0.01 to 0.03 $\mu$m and a second hydrophobized silica having a surface area of from 20 to 50 $m^2/g$.

18. The toner according to claim 1, wherein the external additive comprises a hydrophobized silica, a hydrophobized titanium oxide and a particulate resin having an average particle diameter not greater than one eighth of an average particle diameter of the mother toner particles.

19. An image forming method comprising:

passing a receiving material having a toner image thereon through a nip between a heated fixing means and a pressing means such that the toner image contacts the heated fixing means, to fix the toner image on the receiving material, wherein the toner is a toner according to claim 1.

20. The image forming method according to claim 19, wherein the heated fixing means is a heated fixing roller and the pressing means is a pressure roller, and wherein the heated fixing roller has a heat-resistant elastic layer on a surface thereof and is caved in at the nip.

21. The image forming method according to claim 19, wherein the heated fixing means is a heated fixing belt and the pressing means is a pressure roller, and wherein the heated fixing belt has a heat-resistant elastic layer on a surface thereof and is caved in at the nip.

22. A toner container comprising:

at least an opening, wherein the toner container contains a toner according to claim 1.

23. An image forming apparatus comprising:

an image bearing member configured to bear an electrostatic latent image;

a toner container containing a toner for developing the electrostatic latent image;

an image developer configured to develop the latent image with the toner to form a toner image on the image bearing member;

an image transfer device configured to transfer the toner image on a receiving material; and a fixer configured to fix the toner image on the receiving material, wherein the toner is a toner according to claim 1.

24. The image forming apparatus according to claim 23, wherein the fixer comprises:

a heated fixing belt configured to heat the toner image while contacting the toner image;

a heat roller configured to heat the fixing belt; and a fixing roller configured to support the heated fixing belt together with the heat roller; and a pressure roller configured to press the receiving material bearing the toner image thereon and the fixing belt toward the fixing roller at a nip section between the fixing roller and the pressure roller, wherein at least the fixing belt has a heat-resistant elastic layer on a surface thereof and is caved in at the nip section.

25. The image forming apparatus according to claim 24, wherein the fixing roller has a heat-resistant elastic layer and is also caved in at the nip section.

26. The image forming apparatus according to claim 23, wherein the fixer comprises:

a heated fixing roller configured to heat the toner image while contacting the toner image; and a pressure roller configured to press the receiving material bearing the toner image thereon toward the heated fixing roller at a nip section between the fixing roller and the pressure roller, wherein the fixing roller has a heat-resistant elastic layer on the surface thereof and is caved in at the nip section.

* * * * *